United States Patent [19]

Valerio

[11] 4,270,497

[45] Jun. 2, 1981

[54] OIL PAN FOR INTERNAL COMBUSTION ENGINES

[76] Inventor: Robert M. Valerio, 6208 Selkirk, North Madison, Ohio 44057

[21] Appl. No.: 68,659

[22] Filed: Aug. 22, 1979

[51] Int. Cl.[3] ..... F16N 31/00

[52] U.S. Cl. ..... 123/195 C; 123/198 E; 184/106; 184/6.5

[58] Field of Search ..... 123/195 R, 195 C, 196 R, 123/196 S, 198 R, 198 E, 198 DA; 184/6.5, 6.27, 11 A, 13 R, 106

[56] References Cited

U.S. PATENT DOCUMENTS

| | | | |
|---|---|---|---|
| 1,874,585 | 8/1932 | Newcomb | 184/106 |
| 3,056,501 | 10/1962 | Thorman et al. | 123/196 A |
| 3,101,129 | 8/1963 | Hulten | 184/106 |
| 3,106,263 | 10/1963 | McKellar | 184/106 |
| 3,515,110 | 6/1970 | Deutschmann et al. | 123/195 R |
| 3,724,599 | 4/1973 | Heibacker | 123/198 E |

*Primary Examiner*—Craig R. Feinberg
*Attorney, Agent, or Firm*—Baldwin, Egan, Walling & Fetzer

[57] ABSTRACT

An oil pan for internal combustion engines having a piston—piston rod—crankshaft assembly effecting "splash" lubrication and having a pressurized engine lubrication system. The oil pan substantially reduces unnecessary "splash" and thus increases engine efficiency. The oil pan has a main sump disposed below the bottom wall of the pan for containing oil. There is a side sump disposed in one side wall of the oil pan and in fluid flow communication with the main sump. An elongated windage tray, semi-circular in cross-section, is provided and is positioned longitudinally in the oil pan adjacent the side sump with the convex side down and is spaced above the pan bottom wall. A coacting elongated skimmer bar is positioned above and spaced from an upper edge of the tray adjacent and slightly above the side sump for channeling oil skimmed off the tray into the side sump and then into the main sump in controlled flow. A sponge is disposed in the main sump for retaining a predetermined amount of oil in the sump and for effecting a controlled flow of oil therethrough. The side sump is an outwardly bulging cavity formed in the one side wall of the oil pan and is configured in transverse section to effect a controlled orderly flow of oil received from the skimmer bar into the main sump.

7 Claims, 5 Drawing Figures

OIL PAN FOR INTERNAL COMBUSTION ENGINES

BACKGROUND OF THE INVENTION

This invention relates to oil pans for internal combustion engines having pressurized oil lubrication systems and oil "splash" lubrication, and more particularly to an oil pan configured to reduce unnecessary oil lubrication "splash" and effect a controlled flow of oil therethrough.

In an internal combustion engine containing a piston—piston rod—crankshaft rotating assembly, there is a considerable amount of oil "splash" which occurs in the crankcase. This "splash" is a result of oil on the rotating assembly being flung from the assembly by centrifugal force overcoming the adhesion of the oil to the metal surfaces of the assembly. The oil being flung from the rotating assembly comes from pressure lubrication of the various crankshaft and connecting rod bearings and also from the upper section of the engine (e.g. camshaft and valve lifters) from which it makes its way down and onto the rotating assembly. As engine speed increases, so does the amount and intensity of "splash", such that an undesirable oil splash "windage effect" is created.

More specifically, "splash" is the reaction of the oil when flung from the crankshaft and thence hitting the surfaces of the oil pan. The oil hits the bottom and sides of the oil pan, "splashes" back onto the rotating assembly, thereby adding weight and resistance to the assembly. This increased weight results in added resistance to rotation of the rotating assembly, with the result that the horsepower output of the engine is decreased and the engine becomes less efficient.

Most of the oil that is released from the rotating assembly comes from between the connecting rods and from the crankshaft counterweights. The oil is released tangentially from the point of release.

It is to be understood that a portion of the "splash" is essential for proper lubrication of the engine. However, a very large portion of such "splash" is not needed for lubrication purposes, and it is this unnecessary portion of splash that decreases engine horsepower output.

Therefore, it is an object of the invention to provide an oil pan that eliminates the unnecessary or non-lubricating oil "splash" in internal combustion engines.

A further object of the invention is to provide an oil pan of the above type that increases engine horsepower output and heightens engine efficiency.

A further object of the invention is to provide an oil pan of the above type that is simple in construction, inexpensive to manufacture, and highly effective in operation.

BRIEF DESCRIPTION OF THE INVENTION

Briefly, the foregoing objects are accomplished by the provision of an oil pan for an internal combustion engine having a piston—piston rod—crankshaft assembly and having a pressurized engine lubrication system. The oil pan has the usual side and end walls and a bottom wall, and also has a main sump disposed in and below the bottom wall of the pan for containing oil therein. The oil pan also has a side sump disposed in one side wall of the pan which is in fluid flow communication with the main sump. An elongated windage tray, semi-circular in cross-section, is positioned longitudinally in the oil pan adjacent the side sump with the convex side down and spaced above the pan bottom wall. A coacting elongated skimmer bar is positioned above and spaced from an upper edge of the tray adjacent the side sump for channeling oil skimmed off the tray into the side sump and thence into the main sump in controlled flow. A sponge may be disposed in the main sump for retaining a predetermined amount of oil in the sump and for effecting a controlled flow of oil therethrough. A sponge flange is secured to the pan bottom wall and extends partially over the sponge to retain such sponge in position in the main sump.

There is also provided a plurality of semi-circular tray support straps which are positioned transversely in the oil pan and secured to the pan side walls for supporting the windage tray. The skimmer bar is positioned immediately above the straps and immediately above the side sump.

The side sump is an outwardly bulging cavity formed in the one side wall and is configured in transverse section to effect a controlled orderly flow of oil received from the skimmer bar into the main sump.

More specifically, to reduce the splashing and windage effect of the rotating crankshaft, a solid, semi-circular windage tray is installed in the oil pan below the piston—piston rod—crankshaft rotating assembly. The stream of oil spraying from the rotating assembly contacts the tray tangentially, such tray minimizing or eliminating the "splashing" and also reducing the amount of back pressure (resistance) on the crankshaft. The oil hits the windage tray at a very high speed (and with much energy) and follows the semi-circular path dictated by the tray, such flowing oil then being removed from the tray by the skimmer bar which protrudes from the side of the pan and overlaps the windage tray. The skimmer bar also serves to change the direction of the oil flow and direct such oil flow into the side sump. This is accomplished, in part, by a small gap between the windage tray and the skimmer bar. The oil is directed into this gap by the skimmer bar, which also prevents the oil from traveling up the side of the engine block and onto the rotating assembly. Once into the gap, the oil is directed into the side sump and forced to change direction, forcing it underneath the windage tray, eliminating any such oil splashing up onto the rotating assembly.

The horsepower gain realized from the invention comes from the windage tray—skimmer bar—side sump structure which effects the reduction or elimination of resistance to rotation by the oil stream as it is released from the crankshaft. Because the oil stream is more efficiently removed from the rotating assembly, the crankshaft does not feel the reaction back-up above described.

The semi-circular windage tray has been made substantially resistance or friction free with the application of a thin film of oil repellant coating such as, for example, Teflon (or similar fluorocarbon coating), which eliminates any oil drag on the windage tray itself. This oil drag is inherent in all commercially available oils because of friction modifiers added to induce lubrication. These additives actually make the oil cling to metal surfaces. In the case of the present oil pan of the invention, this characteristic is necessarily negated by the fluorocarbon (in this case, Teflon) coating, further reducing the resistance with which the oil is returned to the oil pan main sump below the tray.

Because the oil is being efficiently removed from the rotating assembly and directed below the tray in such a way that turbulence is kept to a minimum until it is released below the tray, oil "splash" is eliminated. This is because the two main participants in oil splash, i.e. the oil in the sump and the rotating assembly, are separated by the semi-circular windage tray. The oil is not affected by the "wind" created by the rotating assembly, and cannot be blown back onto the moving parts of the engine.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

DESCRIPTION OF THE PREFERRED EMBODIMENTS

Figure 3:
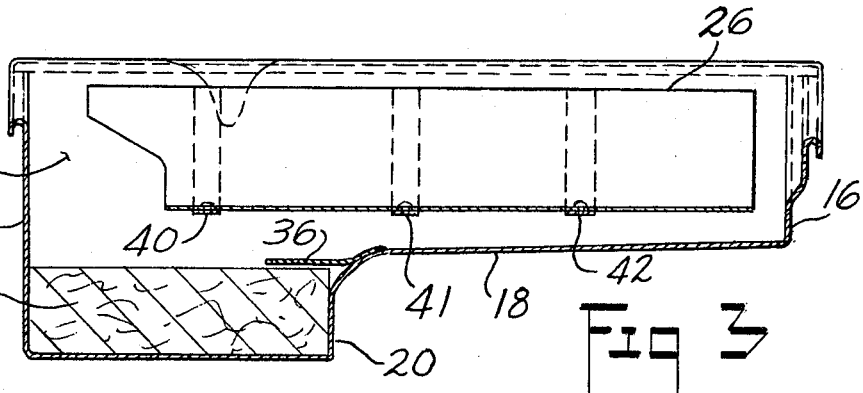
FIG. 3 is a view taken along the line 3—3 of FIG. 1.
Figure 1:
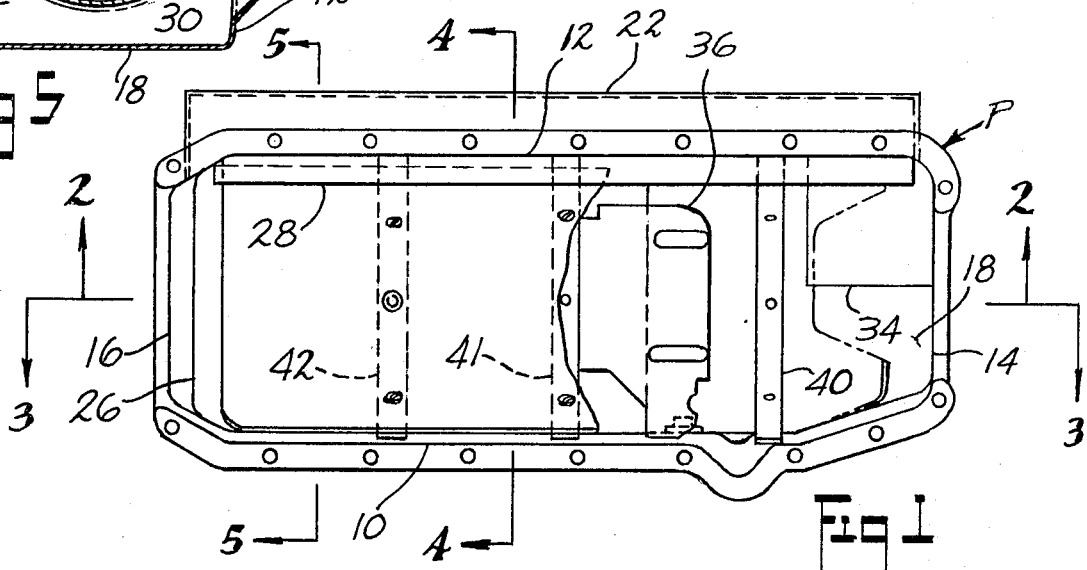
FIG. 1 is a portional top plan view of an internal combustion engine oil pan constructed in accordance with the invention.
Figure 2:
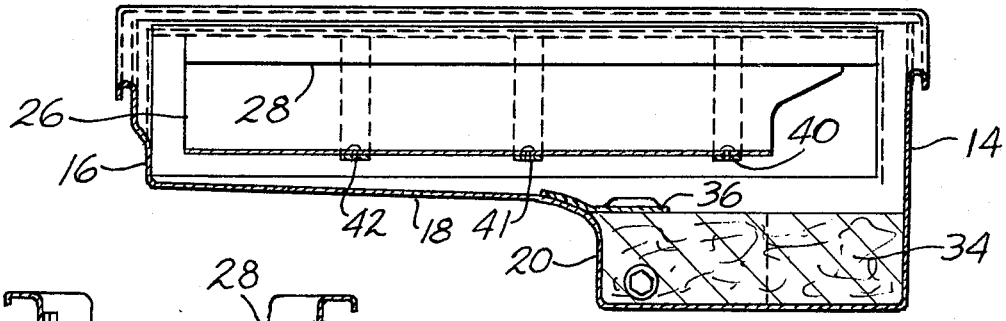
FIG. 2 is a view taken along the line 2—2 of of FIG. 1.

Referring to the drawings, there is shown an oil pan, generally referred to as P (FIG. 1) constructed in accordance with the invention and adapted for use in an internal combustion engine having a piston—piston rod—crankshaft assembly and having a pressurized engine lubrication system. The oil pan P forms an elongated open-top housing having side walls 10, 12 and end walls 14, 16 and a bottom wall 18. Disposed in and below the bottom wall 18 is a main sump 20 (FIGS. 2 and 3) for containing oil. The pan P also has a side sump 22 (FIGS. 4 and 5) disposed in one side wall 12 of the pan and in fluid flow communication with the main sump 20.

An elongated windage tray 26 (FIGS. 1 and 5), semi-circular in cross-section, is positioned longitudinally in the pan P adjacent the side sump 22 with the convex side down and spaced above the bottom wall 18. A coacting elongated skimmer bar 28 is positioned above and spaced from the upper edge 30 of the tray 26 (forming the space 31 therebetween) adjacent the side sump 22 for channeling oil skimmed off the tray 26 into the side sump 22 and thence into the main sump 20 in controlled flow as shown by the arrows in FIG. 5.

In the preferred form, main sump 20 is formed below the bottom wall 18 of the pan P. A sponge 34 may be disposed in the main sump 20 for retaining a predetermined amount of oil in the main sump and for effecting a controlled flow of oil therethrough. A sponge flange 36 is suitably secured to the pan bottom wall 18 and extends partially over sponge 34 to retain the sponge in position in the main sump 20.

A plurality of semi-circular tray support straps 40, 41, 42 are positioned transversely in the oil pan P and suitably secured to the oil pan side walls 10, 12 for supporting the windage tray 26.

The skimmer bar 28 is positioned immediately above the straps 40, 41 and 42 and immediately above the side sump 22.

Figure 5:
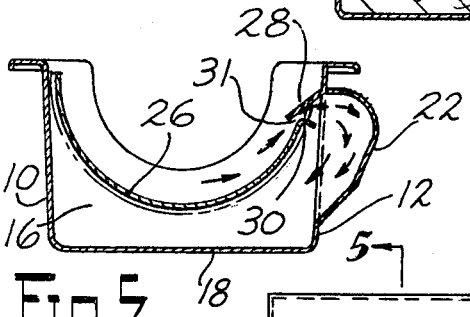
FIG. 5 is a view taken along the line 5—5 of FIG. 1.
Figure 4:
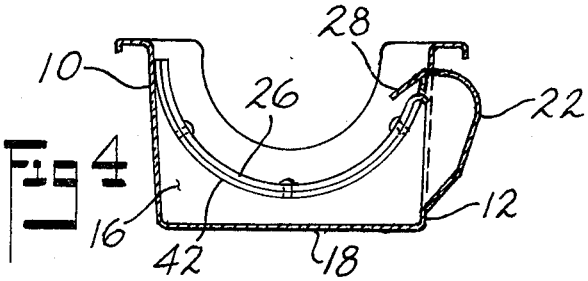
FIG. 4 is a view taken along the line 4—4 of FIG. 1.

The side sump 22, as best shown in FIGS. 4 and 5, is an outwardly bulging cavity formed in the side wall 12 and is configured in transverse section to effect a controlled orderly flow of oil received from the skimmer bar 28 into the main sump 20.

Thus, there is provided an oil pan structure having baffle means such as, for example, the tray 26—skimmer bar 28-side sump 22 structure for reducing the non-lubrication "splash" of the oil by effecting a predetermined flow of oil to the main sump 20 (as shown by the arrows in FIG. 5) to increase engine efficiency.

It is preferred that the tray 26 be coated with a thin film of oil repellant coating such as, for example, Teflon or similar fluorocarbon coating to render such tray resistance or friction free thereby eliminating oil "drag" thereon.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. An oil pan for an internal combustion engine having a piston—piston rod—crankshaft assembly and having a pressurized engine lubrication system, said oil pan comprising; an elongated open-top housing having side and end walls and a bottom wall, said housing also having a main sump disposed in the bottom wall of the housing for containing oil therein, said housing also having a side sump disposed in and formed as a part of one side wall of the housing and in fluid flow communication with said main sump, an elongated windage tray open at both longitudinal ends semi-circular in cross-section and secured to and positioned longitudinally in the housing adjacent the side sump with the convex side down and spaced above the housing bottom wall, and a coacting elongated skimmer bar secured to and formed as a part of said side sump and positioned above and spaced from an upper edge of said tray adjacent the side sump for channeling oil skimmed off the tray into the side sump and thence into the main sump in controlled flow, wherein said side sump is an outwardly bulging cavity formed in said one side wall and is configured in transverse section to effect a controlled orderly flow of oil received from the skimmer bar into the main sump, and wherein said windage tray is coated with an oil repellant coacting to reduce friction.

2. The structure of claim 1 wherein said main sump is formed below said bottom wall of the housing.

3. The structure of claim 1 and further including a plurality of semi-circular tray support straps positioned transversely in said oil pan and secured to the oil pan side walls for supporting the windage tray.

4. The structure of claim 3 wherein the skimmer bar is positioned immediately above said straps and immediately above said side sump.

5. The structure of claim 3 and further including a sponge disposed in and occupying a substantial portion of said main sump for retaining a predetermined amount of oil in the sump and for effecting a controlled flow of oil therethrough.

6. The structure of claim 5 and further including a sponge flange secured to said bottom wall and extending partially over said sponge to retain the sponge in position in the main sump.

7. An oil pan for an internal combustion engine having a piston—piston rod—crankshaft assembly and having a pressurized engine lubrication system, said oil pan comprising; an elongated open-top housing having side and end walls and a bottom wall, said housing also having a main sump disposed in the bottom wall of the housing for containing oil therein, said housing also having a side sump disposed in one side wall of the housing and in fluid flow communication with said main sump, an elongated windage tray semi-circular in cross-section and positioned longitudinally in the housing adjacent the side sump with the convex side down and spaced above the housing bottom wall, a coacting elongated skimmer bar positioned above and spaced from an upper edge of said tray adjacent the side sump for channeling oil skimmed off the tray into the side sump and thence into the main sump in controlled flow, said main sump being formed below said bottom wall of the housing, a sponge disposed in said main sump for retaining a predetermined amount of oil in the sump and for effecting a controlled flow of oil therethrough, a sponge flange secured to said bottom wall and extending partially over said sponge to retain the sponge in position in the main sump, and a plurality of semi-circular tray support straps positioned transversely in said oil pan and secured to the housing side walls for supporting the windage tray, said skimmer bar being positioned immediately above said straps and immediately above said side sump, said side sump being an outwardly bulging cavity formed in said one side wall and configured in transverse section to effect a controlled orderly flow of oil received from the skimmer bar into the main sump.

* * * * *